US010539340B2

(12) United States Patent
Senf, Jr. et al.

(10) Patent No.: US 10,539,340 B2
(45) Date of Patent: Jan. 21, 2020

(54) MULTI-COMPARTMENT TRANSPORT REFRIGERATION SYSTEM WITH EVAPORATOR ISOLATION VALVE

(71) Applicant: CARRIER CORPORATION, Farmington, CT (US)

(72) Inventors: Raymond L. Senf, Jr., Central Square, NY (US); Donald B Hotaling, Jamesville, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 724 days.

(21) Appl. No.: 14/896,819

(22) PCT Filed: Jun. 20, 2014

(86) PCT No.: PCT/US2014/043337
§ 371 (c)(1),
(2) Date: Dec. 8, 2015

(87) PCT Pub. No.: WO2014/209780
PCT Pub. Date: Dec. 31, 2014

(65) Prior Publication Data

US 2016/0138836 A1 May 19, 2016

Related U.S. Application Data

(60) Provisional application No. 61/839,587, filed on Jun. 26, 2013.

(51) Int. Cl.
*F25B 5/02* (2006.01)
*F25B 40/02* (2006.01)
*F25B 49/02* (2006.01)

(52) U.S. Cl.
CPC ..... *F25B 5/02* (2013.01)

(58) Field of Classification Search
CPC ..... F25B 2600/25; F25B 2600/2505; F25B 2600/2515; F25B 2600/2519; F25B 5/02; F25B 5/00
See application file for complete search history.

(56) References Cited

U.S. PATENT DOCUMENTS 2,978,877 A 4/1961 Long
3,537,274 A 11/1970 Tilney
(Continued)

FOREIGN PATENT DOCUMENTS

DE 102006058315 A1 7/2007
WO 8802705 A1 4/1988
(Continued)

OTHER PUBLICATIONS

Carrier Transicold, "Truck/Trailer Refrigeration Unit—Genesis R70, Genesis R90, Genesis TR1000, Multi-Temp, Operation and Service" http://sunbeltcarrier.com/wp-content/uploads/2012/05/GENESIS-R70-R90-TR1000-MT.pdf, 1997, 86 pages.
(Continued)

*Primary Examiner* — Jianying C Atkisson
*Assistant Examiner* — Meraj A Shaikh
(74) *Attorney, Agent, or Firm* — Cantor Colburn LLP

(57) ABSTRACT

A multi-compartment transport refrigeration system includes a heat rejecting heat exchanger downstream of a compressor discharge port; a first evaporator expansion device downstream of the heat rejecting heat exchanger; a first evaporator having an first evaporator inlet coupled to the first evaporator expansion device and a first evaporator outlet coupled to the compressor inlet path, the first evaporator for cooling a first compartment; a second evaporator expansion device downstream of the heat rejecting heat exchanger; a second evaporator having a second evaporator inlet coupled to the second evaporator expansion device and
(Continued)

a second evaporator outlet coupled to the compressor inlet path, the second evaporator for cooling a second compartment; and a first evaporator outlet isolation valve positioned in an outlet of the first evaporator, the first evaporator outlet isolation valve to prevent migration of refrigerant from the second evaporator outlet to the first evaporator outlet.

5 Claims, 3 Drawing Sheets

(56) References Cited

U.S. PATENT DOCUMENTS

| | | | | |
|---|---|---|---|---|
| 4,122,686 | A | 10/1978 | Lindahl et al. | |
| 4,711,095 | A | 12/1987 | Howland et al. | |
| 5,168,713 | A | 12/1992 | Howland | |
| 5,172,559 | A | 12/1992 | Renken et al. | |
| 5,778,690 | A | 7/1998 | Hanson et al. | |
| 7,461,515 | B2 * | 12/2008 | Wellman | F25B 47/022 137/315.33 |
| 8,266,917 | B2 | 9/2012 | Waldschmidt | |
| 2007/0151266 | A1 * | 7/2007 | Yakumaru | F25B 1/10 62/197 |
| 2008/0092564 | A1 | 4/2008 | Sulc et al. | |
| 2008/0289354 | A1 * | 11/2008 | Dudley | F25B 5/02 62/335 |
| 2010/0024450 | A1 | 2/2010 | Waldschmidt et al. | |
| 2011/0088411 | A1 * | 4/2011 | Steele | B60H 1/00014 62/61 |
| 2011/0209490 | A1 | 9/2011 | Mijanovic et al. | |
| 2012/0000222 | A1 | 1/2012 | Fink et al. | |

FOREIGN PATENT DOCUMENTS

| | | | |
|---|---|---|---|
| WO | 2007084138 | A1 | 7/2007 |
| WO | 2008094158 | A1 | 8/2008 |

OTHER PUBLICATIONS

Emerson Climate Technologies, "Solenoid Valves and Their Importance in Refrigeration Systems", http://www.emersonclimate.com/asia/en-AP/WhitePapers/2007FC-23%20R1.pdf, Oct. 2007, 16 pages.
International Search Report for application PCT/US2014/043337, dated Oct. 29, 2014, 4 pages.
Written Opinion for application PCT/US2014/043337, dated Oct. 29, 2014, 4 pages.

* cited by examiner

MULTI-COMPARTMENT TRANSPORT REFRIGERATION SYSTEM WITH EVAPORATOR ISOLATION VALVE

BACKGROUND OF THE INVENTION

Embodiments relate generally to transport refrigeration systems, and more particularly to multi-compartment transport refrigeration systems using one or more evaporator isolation valves.

The refrigerated container of a truck trailer uses a refrigeration unit for maintaining a desired temperature environment within the interior volume of the container. A wide variety of products, ranging for example, from freshly picked produce to deep frozen seafood, are commonly shipped in refrigerated truck trailers and other refrigerated freight containers. To facilitate shipment of a variety of products under different temperature conditions, some truck trailer containers are compartmentalized into two or more separate compartments each of which will typically have a door that opens directly to the exterior of the trailer. The container may be compartmentalized into a pair of side-by-side axially extending compartments, or into two or more back-to-back compartments, or a combination thereof.

Conventional transport refrigeration units used in connection with compartmentalized refrigerated containers of truck trailers include a refrigerant compressor, a condenser, a main evaporator and one or more remote evaporators connected via appropriate refrigerant lines in a closed refrigerant flow circuit. The refrigeration unit must have sufficient refrigeration capacity to maintain the product stored within the various compartments of the container at the particular desired compartment temperatures over a wide range of outdoor ambient temperatures and load conditions.

In addition to the afore-mentioned main evaporator, one or more remote evaporators, typically one for each additional compartment aft of the forward most compartment, are provided to refrigerate the air or other gases within each of the separate aft compartments. The remote evaporators may be mounted to the ceiling of the respective compartments or mounted to one of the partition walls of the compartment, as desired. The remote evaporators are generally disposed in the refrigerant circulation circuit in parallel with the main evaporator and share a common compressor suction plenum. When two or more compartments cool simultaneously in a system with a common suction/evaporation plenum the saturated evaporation temperature is shared between all compartments and coils. The resulting common evaporating temperature is dictated by coldest temperature compartment. Although simplistic, it creates a very inefficient refrigeration cycle.

When two different temperature compartments cool simultaneously on a common evaporation plenum the evaporator for the lowest temperature compartment (e.g., a frozen food compartment) can become a condenser instead of an evaporator and reject heat from the higher temperature compartment when the perishable or higher temperature compartment is trying to cool. A temperature rise of the frozen compartment when a perishable compartment is active is greater than if the frozen compartment was simply turned off. This is due to the fact that condensing latent and sensible heat exchange is happening within the frozen compartment evaporator as the perishable compartment evaporator is trying to cool. When the higher temperature compartment is ordered to cool, the frozen compartment sensed superheat becomes negative due to the pressure rise from higher temperature compartment flow. The frozen compartment expansion valve shuts and temperature rise in the frozen compartment evaporator is significant due to latent and sensible heat exchange as the vapor from the perishable compartment evaporator is re-condensing within the tubes of the frozen compartment evaporator. In order for the saturation pressure of the system to increase, the absolute coil temperature increases in the frozen compartment evaporator generating unwanted heat in the frozen compartment. A significant amount of frozen cooling time (e.g., running an engine and compressor) is spent recovering from the pulsed cooling resulting in net heating effect in the frozen compartment. Additionally this causes a very cold perishable evaporation temperature and significantly more ice formation on the perishable compartment evaporator.

SUMMARY

According to one aspect of the invention a multi-compartment transport refrigeration system includes a compressor having a suction port and a discharge port, the compressor suction port coupled to a compressor inlet path; a heat rejecting heat exchanger downstream of the compressor discharge port; a first evaporator expansion device downstream of the heat rejecting heat exchanger; a first evaporator having an first evaporator inlet coupled to the first evaporator expansion device and a first evaporator outlet coupled to the compressor inlet path, the first evaporator for cooling a first compartment of a container; a second evaporator expansion device downstream of the heat rejecting heat exchanger; a second evaporator having a second evaporator inlet coupled to the second evaporator expansion device and a second evaporator outlet coupled to the compressor inlet path, the second evaporator for cooling a second compartment of the container; and a first evaporator outlet isolation valve positioned in an outlet of the first evaporator, the first evaporator outlet isolation valve to prevent migration of refrigerant from the second evaporator outlet to the first evaporator outlet.

According to another aspect of the invention, a method of operating a multi-compartment transport refrigeration system includes operating a first evaporator to cool a first compartment of a container, a first evaporator outlet coupled to a compressor inlet path; operating a second evaporator to cool a second compartment of a container, a second evaporator outlet coupled to the compressor inlet path; preventing refrigerant exiting the second evaporator outlet from entering the first evaporator outlet.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
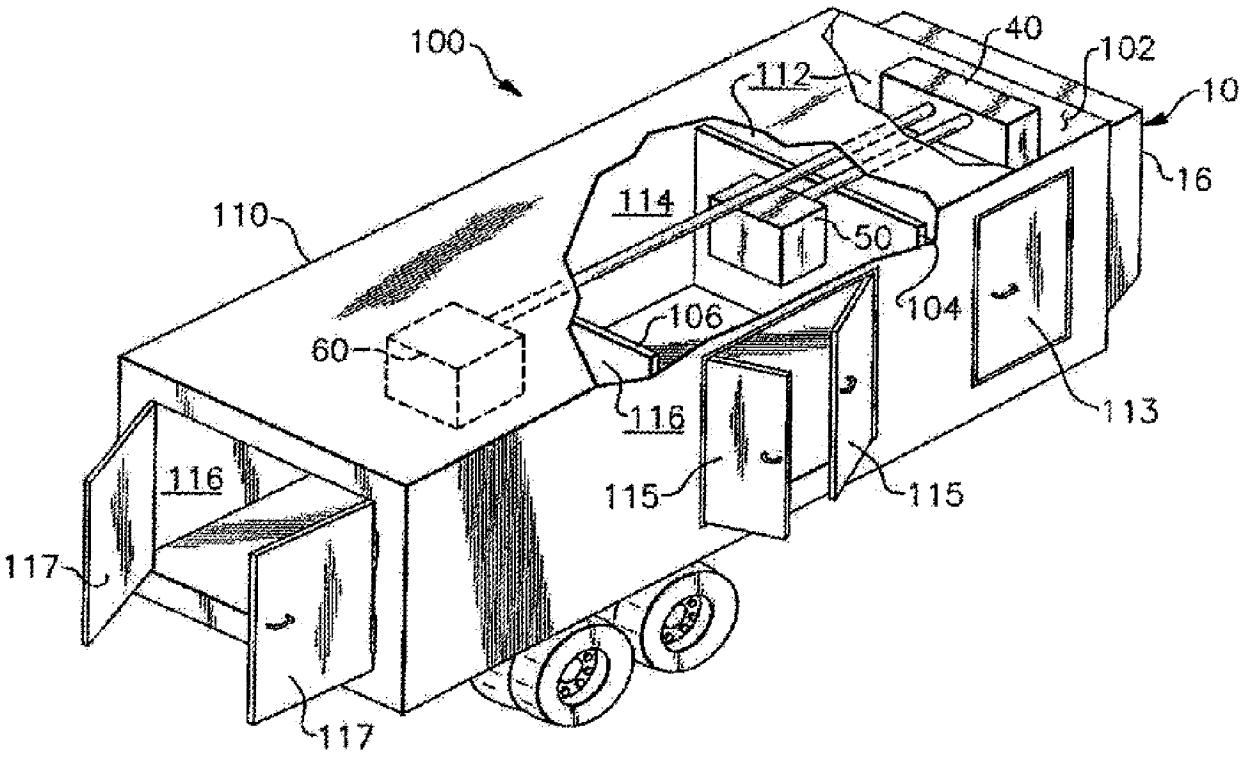
FIG. 1 is a perspective view, partly in section, of a refrigerated truck trailer having a compartmentalized container and equipped with a transport refrigeration unit having multiple evaporators in an exemplary embodiment.

Referring now to FIG. 1, there is shown a truck trailer 100 having a refrigerated container 110 subdivided, i.e., compartmentalized, by internal partition walls 104, 106 into a forward cargo compartment 112, a central cargo compartment 114 and an aft cargo compartment 116. The cargo compartments 112, 114 and 116 have access doors 113, 115 and 117, respectively, which open directly to the exterior of the truck trailer to facilitate loading of product into the respective cargo compartments 112, 114 and 116. The container 100 is equipped with a transport refrigeration system 10 for regulating and maintaining within each of the respective cargo compartments 112, 114 and 116 a desired storage temperature range selected for the product being shipped therein. Although embodiments will be described herein with reference to the three compartment, refrigerated container, illustrated in FIG. 1, it is to be understood that embodiments may also be used in connection with truck trailers having compartmentalized containers with the cargo compartments arranged otherwise, and also in connection with other refrigerated transport vessels, including for example refrigerated container of a truck, or a refrigerated freight container of compartmentalized design for transporting perishable product by ship, rail and/or road transport.

Transport refrigeration system 10 includes a main evaporator 40 and remote evaporators 50 and 60. Each of the evaporators 40, 50 and 60 may comprise a conventional finned tube coil heat exchanger. One or more evaporators (e.g., evaporator 40) may correspond to a frozen product compartment. One or more evaporators (e.g., evaporators 50 and 60) may correspond to a perishable product compartment. The frozen product compartment(s) are kept at a lower temperature than the perishable product compartment(s). The transport refrigeration system 10 is mounted as in conventional practice to an exterior wall of the truck trailer 100, for example the front wall 102 thereof, with the compressor 20 and the heat rejecting heat exchanger 116 (FIG. 2) disposed externally of the refrigerated container 110 in a housing 16.

Figure 2:
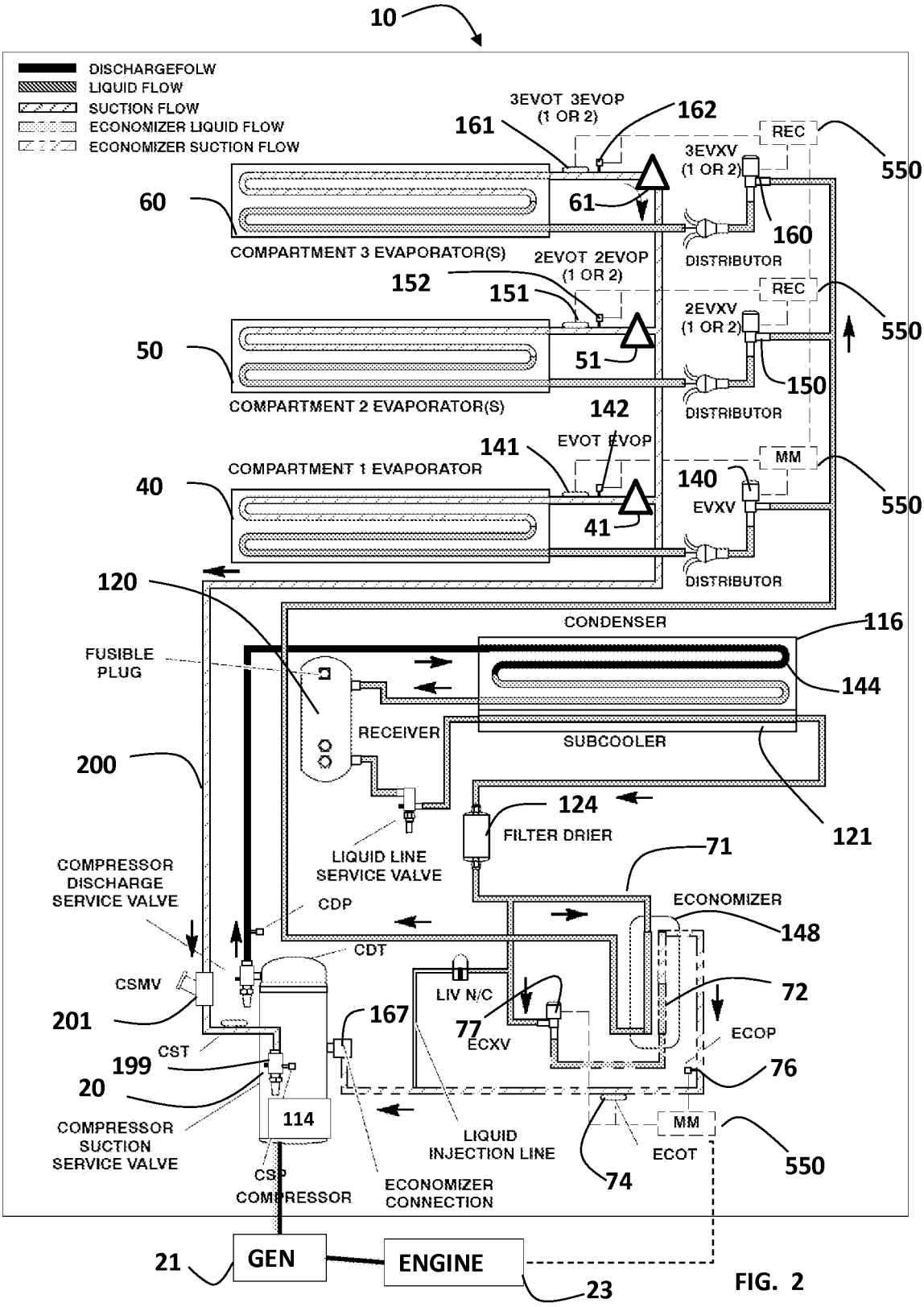
FIG. 2 is a schematic representation of a multiple evaporator transport refrigeration unit in an exemplary embodiment.

FIG. 2 is a schematic representation of the multiple evaporator transport refrigeration unit 10 in an exemplary embodiment. In the depicted embodiment, compressor 20 is a scroll compressor, however other compressors such as reciprocating or screw compressors are possible without limiting the scope of the disclosure. Compressor 20 includes a motor 114 which may be an integrated electric drive motor driven by a synchronous generator 21. Generator 21 may be driven by a diesel engine 23 of a vehicle that tows truck trailer 100. Alternatively, generator 21 may be driven by a stand-alone engine 23. In an exemplary embodiment, engine 23 a diesel engine.

High temperature, high pressure refrigerant vapor exits a discharge port of the compressor 20 then moves to a heat rejecting heat exchanger 116 (e.g., condenser or gas cooler), which includes a plurality of condenser coil fins and tubes 144, which receive air, typically blown by a heat rejecting heat exchanger fan (not shown). By removing latent heat through this step, the refrigerant condenses to a high pressure/high temperature liquid and flows to the receiver 120 that provides storage for excess liquid refrigerant during low temperature operation. From the receiver 120, the refrigerant flows to a subcooler 121, which increases the refrigerant subcooling. Subcooler 121 may be positioned adjacent heat rejecting heat exchanger 116, and cooled by air flow from the heat rejecting heat exchanger fan. A filter-drier 124 keeps the refrigerant clean and dry, and outlets refrigerant to a first refrigerant flow path 71 of an economizer heat exchanger 148, which increases the refrigerant subcooling. Economizer heat exchanger 148 may be a plate-type heat exchanger, providing refrigerant to refrigerant heat exchange between a first refrigerant flow path 71 and second refrigerant flow path 72.

From the first refrigerant flow path 71, refrigerant flows from the economizer heat exchanger 148 to a plurality of evaporator expansion devices 140, 150 and 160, connected in parallel with the first refrigerant flow path 71. Evaporator expansion devices 140, 150 and 160 are associated with evaporators 40, 50 and 60, respectively, to control ingress of refrigerant to the respective evaporators 40, 50 and 60. The evaporator expansion devices 140, 150 and 160 are electronic evaporator expansion devices controlled by a controller 550. Controller 550 is shown as distributed for ease of illustration. It is understood that controller 550 may be a single device that controls the evaporator expansion devices 140, 150 and 160. Evaporator expansion device 140 is controlled by controller 550 in response to signals from a first evaporator outlet temperature sensor 141 and first evaporator outlet pressure sensor 142. Evaporator expansion device 150 is controlled by controller 550 in response to signals from a second evaporator outlet temperature sensor 151 and second evaporator outlet pressure sensor 152. Evaporator expansion device 160 is controlled by controller 550 in response to signals from a third evaporator outlet temperature sensor 161 and third evaporator outlet pressure sensor 162. Evaporator fans (not shown) draw or push air over the evaporators 40, 50 and 60 to condition the air in compartments 112, 114, and 116, respectively.

Refrigeration system 10 further includes a second refrigerant flow path 72 through the economizer heat exchanger 148. The second refrigerant flow path 72 is connected between the first refrigerant flow path 71 and an intermediate inlet port 167 of the compressor 20. The intermediate inlet port 167 is located at an intermediate location along a compression path between compressor suction port and compressor discharge port. An economizer expansion device 77 is positioned in the second refrigerant flow path 72, upstream of the economizer heat exchanger 148. The economizer expansion device 77 may be an electronic economizer expansion device controlled by controller 550. When the economizer is active, controller 550 controls economizer expansion device 77 to allow refrigerant to pass through the second refrigerant flow path 72, through economizer heat exchanger 148 and to the intermediate inlet port 167. The economizer expansion device 77 serves to expand and cool the refrigerant, which proceeds into the economizer counterflow heat exchanger 148, thereby sub-cooling the liquid refrigerant in the first refrigerant flow path 71 proceeding to evaporator expansion devices 140, 150 and 160.

As described in further detail herein, many of the points in the refrigerant vapor compression system 10 are monitored and controlled by a controller 550. Controller 550 may include a microprocessor and its associated memory. The memory of controller can contain operator or owner preselected, desired values for various operating parameters within the system 10 including, but not limited to, temperature set points for various locations within the system 10 or the container, pressure limits, current limits, engine speed limits, and any variety of other desired operating parameters or limits with the system 10. In an embodiment, controller 550 includes a microprocessor board that contains microprocessor and memory, an input/output (I/O) board, which contains an analog to digital converter which receives temperature inputs and pressure inputs from various points in the system, AC current inputs, DC current inputs, voltage inputs and humidity level inputs. In addition, I/O board includes drive circuits or field effect transistors ("FETs") and relays which receive signals or current from the controller 550 and in turn control various external or peripheral devices in the system 10.

Outlets of evaporators 40, 50 and 60 are coupled to a common compressor inlet path 200. The common compressor inlet path 200 is coupled to a compressor suction port through a compressor suction modulation valve 201 and a compressor suction service valve 199. Because evaporators 40, 50 and 60 share a common suction plenum, refrigerant exiting a first evaporator (e.g., evaporator 60 for a perishable product compartment) can migrate to a second evaporator (e.g., evaporator 40 for a frozen product compartment) and condense. This causes heating of the second evaporator, which is undesired.

To control the migration of refrigerant at the outlets of evaporators 40, 50 and 60, each evaporator outlet includes an isolation valve 41, 51 and 61. Isolation valves 41, 51 and 61 at the outlet of each evaporator prevent the reverse condensing effect within the coldest compartment. Although each evaporator 40, 50 and 60 is depicted having an outlet isolation valve 41, 51, 61, it is understood that less than all the evaporators may be equipped with an outlet isolation valve. For example, as reverse condensation typically occurs at the evaporator for the coldest compartment, a single outlet isolation valve may be used on the evaporator for the frozen food compartment. By using outlet isolation valve 41, 51, 61, the reverse flow and subsequent heating effect of the coldest evaporator is eliminated by preventing the higher temperature vapor flow from re-condensing within the cold tubes of the frozen product compartment evaporator.

Outlet isolation valves 41, 51, 61 may be implemented in a variety of ways. In one embodiment, a reverse flow check valve is used. In another embodiment, outlet isolation valves 41, 51, 61 are electronically controlled valves (e.g., a solenoid valve) under the control of controller 550.

Figure 3:
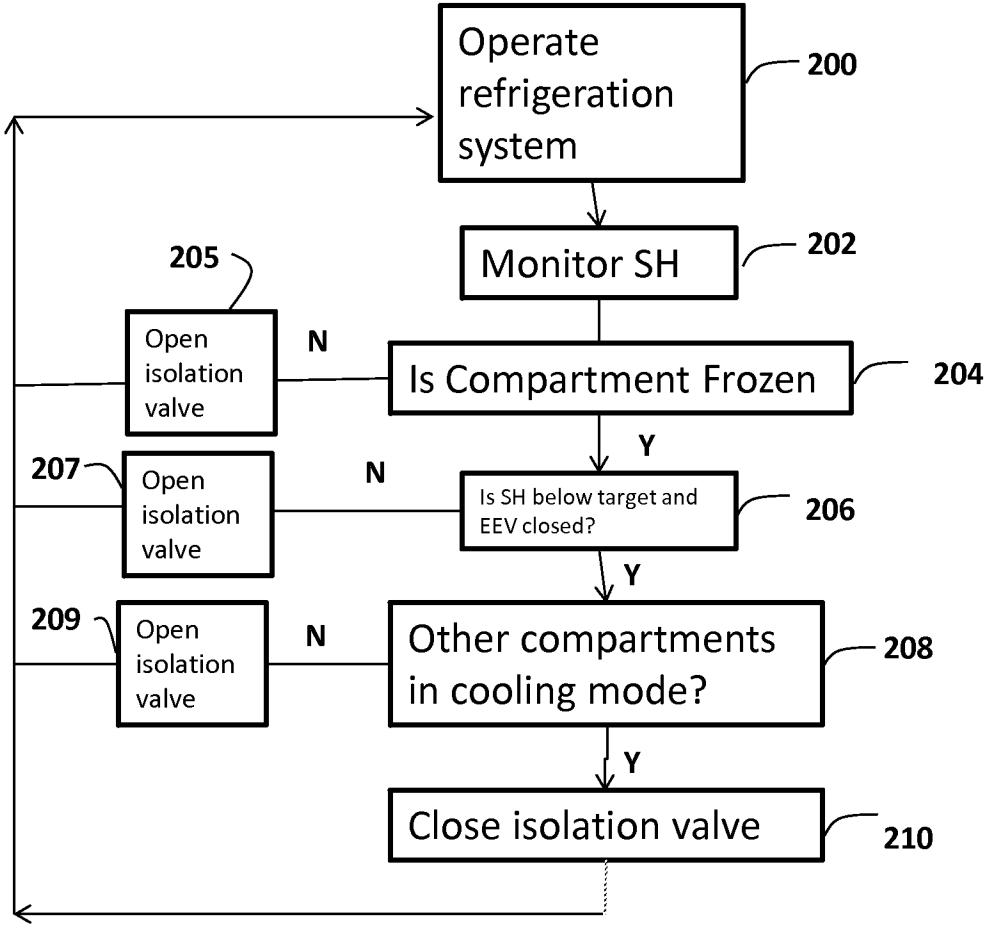
FIG. 3 is a flowchart of a method for controlling the multi-compartment refrigeration system in an exemplary embodiment.

FIG. 3 is a flowchart of a method for controlling the multi-compartment refrigeration system in an exemplary embodiment where outlet isolation valves 41, 51, 61 are electronically controlled. The process may be implemented by controller 550. The process begins at 200 where the refrigeration system is operated under normal conditions to control temperatures in the multiple compartments. At 202, the superheat at evaporators 40, 50 and 60 is monitored, based on temperature and/or pressure at the evaporator outlets.

At 204, it is determined if a compartment is frozen. This may be determined based on a temperature sensor in each compartment. If no compartment is frozen, then flow proceeds to 205, where the isolation valves remain open.

At 206, it is determined if one or more superheat measurements for evaporators 40, 50 and 60 is below a target level and the corresponding evaporator expansion devices 140, 150 and 160 are closed. The superheat target level (e.g., 10 degrees) may be selected to be indicative that refrigerant is migrating from one evaporator to another along the common suction plenum and condensing in the colder evaporator. If the superheat is not below a target level or the evaporator expansion devices are not closed, then flow proceeds to 207, where the isolation valves remain open.

If the superheat is below a target level and the evaporator expansion devices is closed for that compartment, then flow proceeds to 208, where it is determined whether any other compartments are operating in cooling mode. If not, flow proceeds to 209, where the isolation valves remain open. If at 208, another compartment(s) are operating in cooling mode, flow proceeds to 210 where the outlet isolation valve is closed for the evaporator with the superheat below the target level. Controller 550 may issue a control signal to the outlet isolation valve to close. This prevents migration of refrigerant into the coldest evaporator and subsequent condensation. The isolation valve may be reopened when any of the conditions in 204, 206 and 208 become false.

As noted above, in exemplary embodiments, outlet isolation valves 41, 51, 61 are mechanical check valves. In these embodiments, no automated control is used. Rather, the outlet isolation check valves 41, 51, 61 are selected such that a pressure differential of greater than a pressure limit (e.g., 2-3 pounds) causes an outlet isolation check valve to close. Again, this prevents migration of refrigerant into the coldest evaporator and subsequent condensation.

Embodiments provide significant improvement in efficiency by improving applied capacity and reducing diesel engine run time. Several minutes of frozen run time are consumed just to recover from these net re-heat cycles when a perishable compartment attempts a cooling. Better compressor reliability can be observed because the condensing phenomena are eliminated and the risk of system flooding and compressor slugging is much lower. Embodiments also provide a significant reduction in unwanted perishable frost formation on the perishable evaporator. With isolation control, the perishable compartment will evaporate its refrigerant at much higher evaporation temperature resulting in much less frost formation and repeat defrosts from the current high refrigerant to air temperature differential. Better refrigerant and compressor oil management is also provided. The perishable compartment capacity also improves because its evaporation temperature will be much higher and closer to the air temperature resulting in higher compressor suction density and capacity. These all lead to much greater system efficiency.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A multi-compartment transport refrigeration system comprising:

a compressor having a suction port and a discharge port, the compressor suction port coupled to a compressor inlet path;

a heat rejecting heat exchanger downstream of the compressor discharge port;

a first expansion device downstream of the heat rejecting heat exchanger;

a first evaporator having an first evaporator inlet coupled to the first expansion device and a first evaporator outlet coupled to the compressor inlet path, the first evaporator for cooling a first compartment of a container;

a second expansion device downstream of the heat rejecting heat exchanger;

a second evaporator having a second evaporator inlet coupled to the second expansion device and a second evaporator outlet coupled to the compressor inlet path, the second evaporator for cooling a second compartment of the container; and a first evaporator outlet isolation valve positioned in an outlet of the first evaporator, the first evaporator outlet isolation valve being closable to prevent migration of refrigerant from the second evaporator outlet to the first evaporator outlet, wherein the first evaporator outlet isolation valve is an electronically controlled valve;

a controller, the controller generating a control signal to close the first evaporator outlet isolation valve in response to superheat at the first evaporator;

wherein the controller is configured to close the first evaporator outlet isolation valve in response to all of (i) the first compartment being frozen, and (ii) the superheat at the first evaporator being below a target, and (iii) the first evaporator expansion device being closed and the second evaporator being in cooling mode, occurring simultaneously.

2. The multi-compartment transport refrigeration system of claim 1 wherein:

the first evaporator outlet isolation valve is a check valve.

3. The multi-compartment transport refrigeration system of claim 1 wherein:

the first compartment is maintained at a first temperature, the second compartment is maintained at a second temperature, the first temperature lower than the second temperature.

4. A method of operating a multi-compartment transport refrigeration system, the method comprising:

operating a first evaporator to cool a first compartment of a container, a first evaporator outlet coupled to a compressor inlet path;

operating a second evaporator to cool a second compartment of a container, a second evaporator outlet coupled to the compressor inlet path;

closing a first evaporator outlet isolation valve positioned at the first evaporator outlet to prevent refrigerant exiting the second evaporator outlet from entering the first evaporator outlet;

wherein closing the first evaporator outlet isolation valve positioned at the first evaporator outlet occurs in response to a control signal;

generating the control signal to close the first evaporator outlet isolation valve in response to all of (i) the first compartment being frozen, and (ii) the superheat at the first evaporator being below a target, and (iii) the first evaporator expansion device being closed and the second evaporator being in cooling mode, occurring simultaneously.

5. The multi-compartment transport refrigeration system of claim 1 further comprising a compressor suction modulation valve downstream of the first evaporator outlet isolation valve and upstream of the compressor suction port.

* * * * *